United States Patent [19]

Fujino

[11] 4,316,064

[45] Feb. 16, 1982

[54] REMOTE OPERATION DEVICE

[75] Inventor: Hitoshi Fujino, Furukawa, Japan

[73] Assignee: Alps Electric Co., Ltd., Tokyo, Japan

[21] Appl. No.: 155,145

[22] Filed: May 30, 1980

[30] Foreign Application Priority Data

May 31, 1979 [JP] Japan ..... 54/73646

[51] Int. Cl.[3] ..... H01H 3/00; H01H 15/00

[52] U.S. Cl. ..... 200/17 R; 200/18

[58] Field of Search ..... 200/17 R, 18, 153 R, 200/153 L, 153 LA, 153 LB, 153 D, 161, 330, 337

[56] References Cited

U.S. PATENT DOCUMENTS 4,121,063 10/1978 Aimi ..... 200/18

4,260,866 4/1981 Fujino et al. ..... 200/330

*Primary Examiner*—James R. Scott

*Attorney, Agent, or Firm*—Guy W. Shoup; Gerard F. Dunne

[57] ABSTRACT

A remote operation device for operating a plurality of remotely positioned electric parts simultaneously by an actuation of a single operation member. The device has the operation member, interconnection members each having a flexible sleeve and a metallic belt slidably received by the sleeve, and operated members connected to the operating portions of the electric parts. The metallic belts of the interconnection members are superposed at their one ends to one another and are secured commonly to a movable connection member slidably mounted in the operating member, while the other ends of the metallic belts are connected to movable connection members slidably received by respective operated members. As the signal movable connection member of the operation member is moved in one direction, the movement is transmitted through respective metallic belts to respective operated members, so that the electric parts are operated simultaneously.

3 Claims, 4 Drawing Figures

REMOTE OPERATION DEVICE

BACKGROUND OF THE INVENTION

The present invention relates to a remote operation device adapted for remotely operating an electric component operable slidably, such as a slide switch, and, more particularly, to a remote operation device capable of simultaneously operating a plurality of electric components at remote places by an operation from a single point.

A device adapted to operate an electric component such as a slide switch remotely from an operation panel has been developed. This known device has a connection member consisting of a metallic belt slidably accommodated within a flat flexible sleeve made of a plastic. An operation member and the electric component to be operated are connected to respective ends of the connection belt. The operation member is attached to the operation panel. In use, the operation member is manually actuated so that the movement of the operation member is transmitted by movement of the metallic belt through the sleeve to operate the electric component.

Such devices are described, for example, in the specification of the U.S. Pat. No. 4,121,063. Also, U.S. patent application Ser. No. 33,574 filed Apr. 27, 1979, now U.S. Pat. No. 4,260,866 assigned to the same assignee as this application discloses a similar device. These known devices are adapted to operate remotely only one electric component through the operation of the operation member.

On the other hand, there often is a need for operating remotely a plurality of electric components simultaneously. This need, however, cannot be fully met by conventional remote operation devices. For fulfilling such a need with conventional devices, it is necessary to install a plurality of such devices, together with a device for simultaneously actuating these units, on the operation panel. Such an arrangement is expensive and requires a considerably large installation space.

SUMMARY OF THE INVENTION

It is, therefore, a major object of the invention to provide a remote operation device capable of simultaneously operating a plurality of electric components positioned at remote places by actuation of a single operation member.

It is another object of the invention to provide a remote operation device having a plurality of interconnection members.

It is still another object of the invention to provide a remote operation device which is inexpensive and which permits an efficient use of the available space.

To these ends, according to the invention, there is provided a remote operation device having a plurality of interconnection members which are secured at their one ends to a common single operation member and at their other ends to corresponding ones of a plurality of members to be operated, so that a plurality of electric components disposed at remote places are simultaneously operated by an actuation of the single operation member.

These and other objects, as well as advantageous features of the invention will become clearer from the following description of the preferred embodiments taken in conjunction with the accompanying drawings.

DESCRIPTION OF THE PREFERRED EMBODIMENTS

Figure 1:
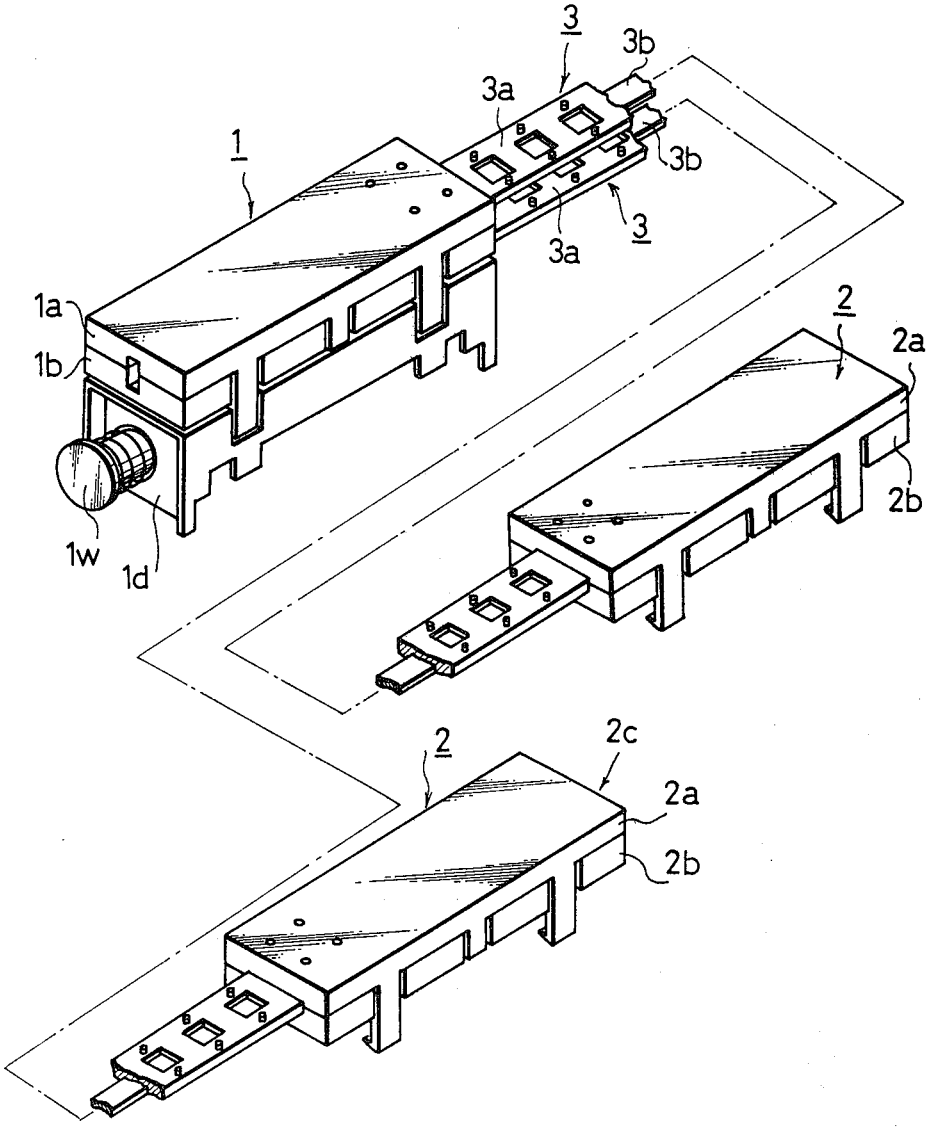
FIG. 1 is a perspective view of a remote operation device in accordance with an embodiment of the invention.
Figure 2:
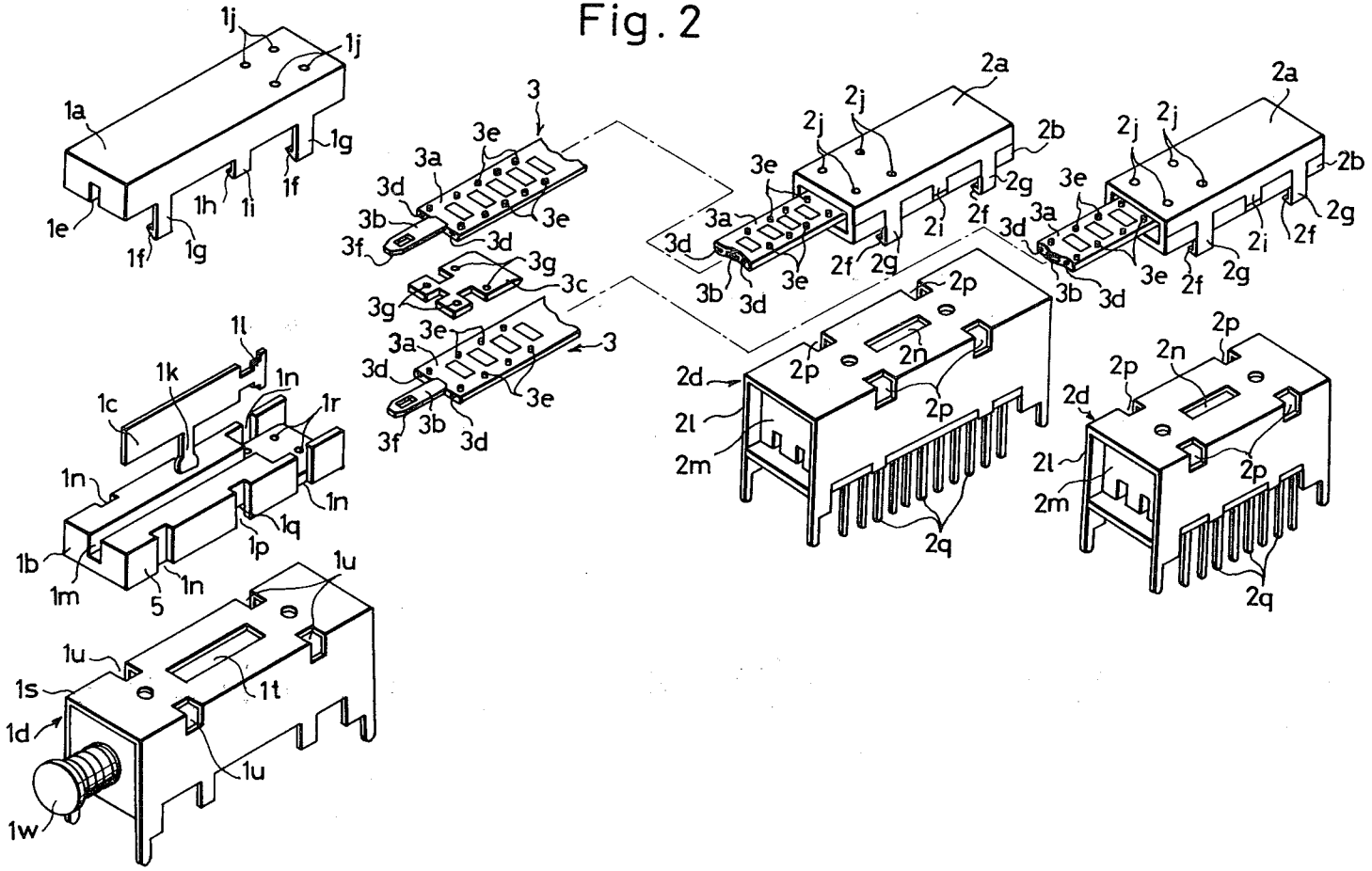
FIG. 2 is an exploded perspective view of a remote operation device constructed in accordance with an embodiment of the invention.

Referring to FIG. 1, a remote operation device of the invention includes a single operation member 1, two operated members 2,2 and two interconnection members 3,3. As will be clearly understood also from FIGS. 2 and 3, the operation member 1 is constituted by an upper frame 1*a*, lower frame 1*b*, movable connection member 1*c* slidably received within a chamber 1*z* formed when the upper and lower frames 1*a* and 1*b* are fitted together, and a driving portion 1*d* adapted for driving the movable connection member 1*c*.

Also, each operated member 2 is constituted by an upper frame 2*a*, a lower frame 2*b*, a movable connection member 2*c* (See FIG. 3) slidably received by a chamber 2*z* formed when the upper and lower frames 2*a* and 2*b* are fitted together, and an operating portion 2*d* of a slide switch or the like adapted to be moved in response to the sliding movement of the movable connection member 2*c*. Further, the interconnection member 3 is constituted by a flattened belt-like sleeve 3*a* formed of a flexible material such as a thermoplastic resin, and a metallic belt 3*b* slidably received by and extending in the sleeve. A spacer 3*c* is interposed between adjacent ends of the two interconnection members 3,3 located near the operation member 1.

The upper frame 1*a* is formed of a plastic and is provided with a longitudinal groove 1*e* in the lower face thereof. At the same time, four engaging lugs 1*g*, each having an engaging projection 1*f*, are projected downward from the four corners of the upper frame 1*a*. Further, two engaging projections 1*i*, each having an engaging projection 1*h*, are projected downward from both sides of the central part of the upper frame 1*a*. The upper frame 1*a* is further provided at its one end portion with four circular bores 1*j* extending vertically through the thickness thereof.

The aforementioned movable connection member 1*c* is formed by punching a metal sheet substantially in a T-shape, and is provided at its lower end with an arm portion 1*k* and at one end with two caulking portions 1*e*,1*e* to which two metallic belts 3*b*,3*b* of the interconnection members are to be connected.

The lower frame 1*b* is formed of a plastic and is provided in its upper surface with a longitudinal groove 1*m* a part of which constitutes a narrow groove which extends from the upper half of the lower frame 1*b* completely through to the lower face thereof so as to receive the arm 1*k*. A reference numeral 1*n* designates recesses formed at both sides of both end portions of the lower frame 1*b*, while recesses formed at both sides of the central portion of the lower frame 1*b* are designated at 1*p*. Each recess 1*p* has a step 1*q*. The lower frame 1*b* is further provided with four circular bores 1r. A numeral 1d denotes the aforementioned driving portion, while a numeral 1s denotes a case adapted to accommodate an operation rod or the like member. A groove 1t for receiving the arm 1k of the movable connection member 1c is formed at the center of the case 1s, and four notched grooves 1u for engagement with respective engaging projections 1f are formed at respective corners.

The interconnection member 3 has the sleeve 3b formed of a thermoplastic resin in the shape of a ladder since it has a plurality of window portions and is provided at its lateral sides with outer wires 3d embedded therein. The sleeve 3b has a central axial bore which slidably receives a web-like metallic belt 3b made of stainless steel. Engaging projections 3e are formed on the upper and lower faces of the sleeve 3a, whereas engaging apertures 3f are formed in the ends of the metallic belt 3b. The aforementioned spacer 3c is formed of plastic and is provided with four through bores 3g for engagement with the engaging projections 3e formed on the upper and lower faces of the two sleeves 3a.

The upper and lower frames 2a,2b of the operated members have constructions substantially identical to those 1a,1b of the operation member 1. Namely, the upper frame 2a has four engaging lugs 2g, each having an engaging projection 2f, which are projected downwardly from respective corners thereof. Also, two engaging lugs 2i each having an engaging projection are suspended from respective sides of a central part of the upper frame 2a. Finally, four circular bores 2j are formed in one end portion of the upper frame 2a through the thickness of the latter.

Referring now to the lower frame 2b, four recesses for engagement with the engaging lugs 2g are formed at respective corners. Also, two recesses for engagement with the engaging lugs 2i are formed in both sides of the central portion of the lower frame 2b.

Figure 3:
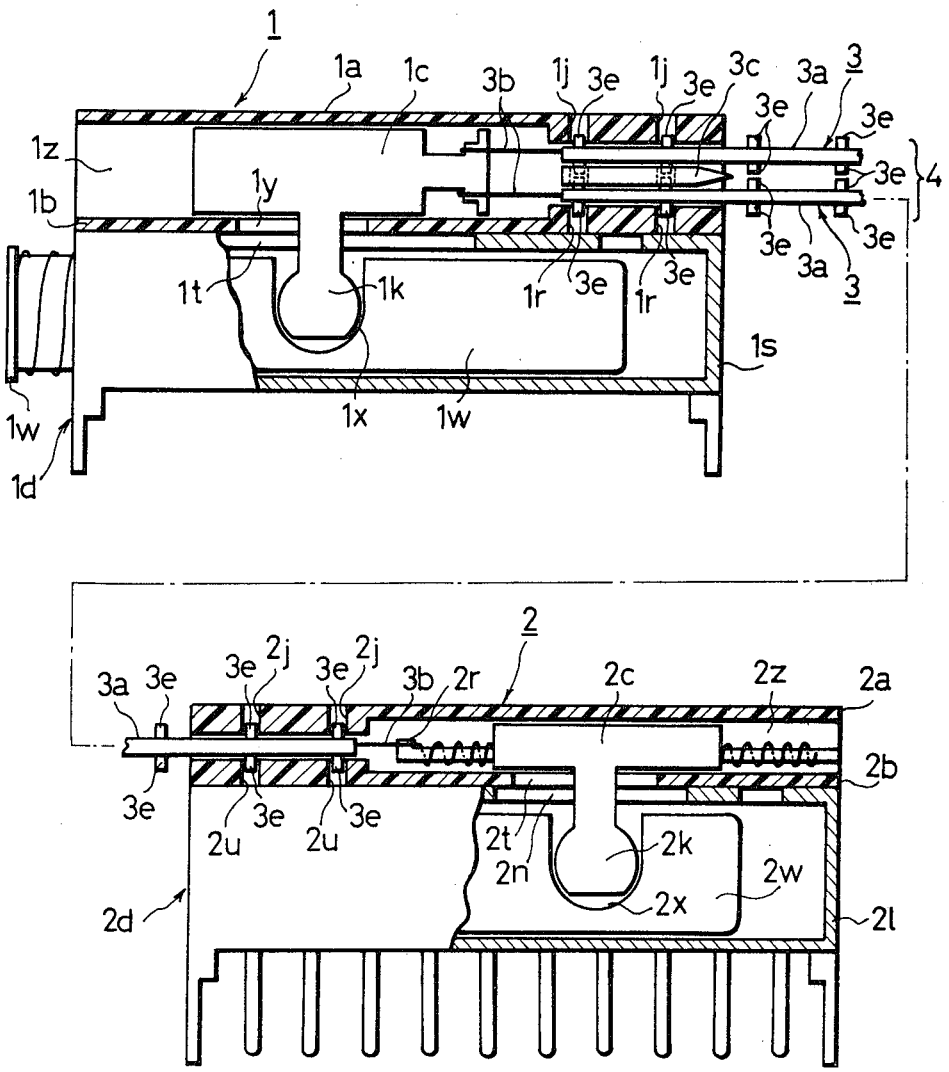
FIG. 3 is a sectional front elevational view of a remote operation device constructed in accordance with an embodiment of the invention.

The operating portion 2d of a slide switch or the like is composed of a case 21 and an operation unit 2m encased by the latter. A groove 2n is formed at the central portion of the case 21 so as to receive the arm 2k of the movable connection member 2c which is slidably received by the chamber 2z as shown in FIG. 3.

Also, four notched grooves 2p for engaging the engaging projections 2f are formed at respective corners. The operation unit 2m has a plurality of connection pins 2q.

Hereinafter, a description will be made as to how the remote operation device of the invention is assembled.

For assembling the operation member 1, the metallic belts 3b,3b are received slidably by the sleeves 3a,3a, and the engaging apertures 3f,3f formed at an end of each belt of respective interconnection members 3,3 are fitted to the caulking portions of the movable connection member 1c. Then, the caulking portions are caulked to firmly secure the ends of the metallic belts to the movable connection member 1c.

Subsequently, the spacer 3c is placed between the sleeves 3a,3a. Namely, the engaging projections 3e on the surface of the underlying sleeve are fitted to corresponding through bores 3g of the spacer 3c. At the same time, the engaging projections 3e of the lower face of the overlying sleeve are fitted to the through bores 3g of the spacer 3c. In consequence, a multi-layer connection body 4 having two sleeves superposed and connected at their one ends adjacent the operating member 1 is formed.

Subsequently, the arm 1k of the movable connection member 1c is fitted through the groove 1m of the lower frame 1b. In this case, the arm 1k projects downwardly from the groove 1y continuous from the groove 1m, and the engaging projections 3e provided on the lower side of the underlying sleeve of the multi-layer connection body 4 are received by the circular bores 1r of the lower frame 1b.

Then, the upper frame 1a is laid over the lower frame 1b to which the movable connection member 1c and the multi-layer connection body 4 have been secured, to make the engaging lugs 1g fit the recesses 1n. Then, as the upper frame 1a is pressed to the lower frame 1b, the engaging projections 1f of the engaging lugs 1i fit into the steps 1q of the recesses 1p, thereby to hold the upper and lower frames 1a,1b together. In this state, the engaging projections 3e of the overlying sleeve of the multi-layer connection body fit the circular bores 1j of the upper frame, whereas the upper end of the movable connection member 1c loosely fits the groove 1e of the upper frame 1a.

Finally, the arm 1k projecting downward from the united stationary frame, i.e. from the lower frame 1b, is inserted into the groove 1t of the driving part case 1s, and the engaging projections 1f of the upper frame 1a are brought into engagement with the notched grooves 1u. In this state, the arm 1k into a connection groove 1x of an operation rod 1w. The operation member 1 is thus assembled.

Referring now to the assembling of each operated member 2, after fitting the engaging bores at the other end of the respective metallic belt 3b to the caulking portion 2r of the movable connection member 2c, the caulking portion is caulked to firmly secure the metallic belt 3b to the movable connection member 2c. Subsequently, the arm 2k of the movable connection member 2c is fitted to the groove 2t of the lower frame 2b. By so doing, the engaging projections 3e of the sleeve 3a are brought into engagement with the circular bores 2u of the lower frame 2b.

Thereafter, the upper frame 2a is laid over the lower frame 2b to which the movable connection member 2c and the interconnection member 3 have been secured. Then, the engaging lugs 2g are fitted to the recesses of the lower frame 2b thereby to hold the upper and lower frames together. In this state, the engaging projections 3e formed on the surface of the interconnection member 3 are fitted to the circular bores 2j of the upper frame 3e.

Finally, the arm 2k projecting downwardly from the lower side of the unitarized stationary frame, i.e. from the lower frame 2b, is introduced into the groove 2n of the operation unit case 21 and the engaging projections 2f of the engaging lugs 2g of the upper frame 2a are fitted to the notched grooves 2p. In this state, the arm 2k is received by a connection groove 2x of a slider 2w. The assembling of the operated member is thus completed. The other operated member or members, if there are any, are assembled in the same manner.

A description will be made hereinunder as to the operation of the remote operation device in accordance with the invention.

As the operation rod 1w is pressed, the movement of the operation rod 1w is transmitted through the arm 1k to the movable connection member 1c to cause a sliding movement of the latter. In consequence, the metallic belts 3b,3b connected to the movable connection member 1*k* are displaced, so that the movable connection members 2*c* of respective operation members 2 are slid simultaneously. As a result, the sliders 2*w* of the operating portions 2*d* of the slide switches or the like are slid through the movement of the arms 2*k* to simultaneously operate the slide switches or the like. Needless to say, the sliders 2*w* of the operated members 2 are slid in the reverse direction, if the operation rod 1*w* is pulled.

Figure 4:
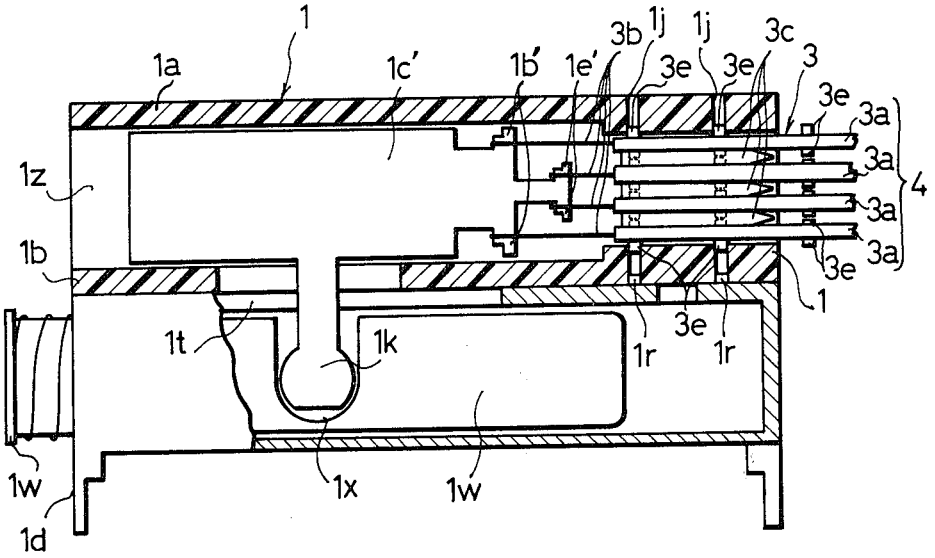
FIG. 4 is a sectional front elevational view of a remote operation device constructed in accordance with another embodiment of the invention.

FIG. 4 is a sectional front elevational view of the operation member 1 to which four interconnection members 3 are secured to permit four remotely positioned slide switches or the like to be operated at a time. The members and parts designated at the same reference numerals are identical to those of FIG. 3, and, therefore, are not detailed here.

In FIG. 4, a reference numeral 1*c*′ denotes a movable connection member having four caulking portions 11′ to each of which secured by caulking its one end of metallic belt 3*b* of each of four interconnection members. A spacer 3*c* is disposed between the sleeves 3*a* of each pair of adjacent interconnection member 3, thereby to form a multi-layer connection body 4 having four layers. The engaging projections 3*e* on the surface of the sleeve constituting the uppermost layer of the multi-layer connection body 4 are received by the circular bores 1*j* of the upper frame 1*a*, while the engaging projections 3*e* formed on the reverse side of the sleeve constituting the lowermost layer fit the circular bores 1*r* of the lower frame 1*b*. In consequence, the multi-layer connection body 4 is connected at its one end to the upper and the lower frames 1*a*,1*b*. The other ends of respective interconnection members 3 are of course connected to the corresponding operated members.

What is claimed is:

1. A remote operation device for interconnecting a plurality of remote electric components operated by slide elements with a single actuator for operating each of said remote electric components upon operation of said actuator, including a plurality of resilient interconnection members each adapted to engage a respective one of said remote electric components and including a sleeve member slidably receiving a slide member, said sleeve members each including means on one end portion for attaching it to the slide element of a respective electric component and means at its other end portion for attaching it to said actuator, whereby each of said electric components may be widely spaced and yet operated simultaneously by operation of said actuator.

2. A device according to claim 1, each end portion of the respective sleeve members includes projections formed on the upper and lower surfaces thereof, said projections being adapted to be received in complementary recesses formed in said actuator and said respective electric components.

3. A device according to claim 2, further including a spacer fitting between adjacent ones of said other end portions and having recesses adapted to receive projections of said other end portions.

* * * * *